United States Patent [19]

Carlomagno et al.

[11] 4,043,799

[45] Aug. 23, 1977

[54] METHOD AND DEVICE FOR BLOWING OXYGEN IN METAL REFINING CONVERTERS IN UNSTATIONARY MANNER

[75] Inventors: Giovanni Maria Carlomagno; Bruno Costa, both of Naples, Italy

[73] Assignee: Italsider S.p.A., Genoa, Italy

[21] Appl. No.: 709,755

[22] Filed: July 29, 1976

Related U.S. Application Data

[63] Continuation-in-part of Ser. No. 590,227, June 25, 1975, which is a continuation of Ser. No. 391,382, Aug. 24, 1973, abandoned.

[51] Int. Cl.[2] ..... C21C 5/30

[52] U.S. Cl. ..... 75/60

[58] Field of Search ..... 75/60, 59, 51, 52

[56] References Cited

U.S. PATENT DOCUMENTS

| | | | |
|---|---|---|---|
| 2,820,707 | 1/1958 | Walker | 75/60 |
| 2,851,351 | 9/1958 | Cuscoleca | 75/60 |
| 2,979,395 | 4/1961 | Kosmider | 75/60 |
| 2,991,174 | 7/1961 | McVicker | 75/60 |

*Primary Examiner*—Peter D. Rosenberg
*Attorney, Agent, or Firm*—Nolte and Nolte

[57] ABSTRACT

The invention provides variation in the delivery of oxygen to converters for refining metal. Thus, oxygen blowing into such converters in unstationary manners, i.e., varying degrees of pressure and/or flow rate, is performed by means of partialization of the nozzles of the lance heads, or by means of decreases in the penetration capacities of the oxygen jets throughout the blowing process or during a part only of the same resulting in greatly improved reaction rates.

12 Claims, 16 Drawing Figures

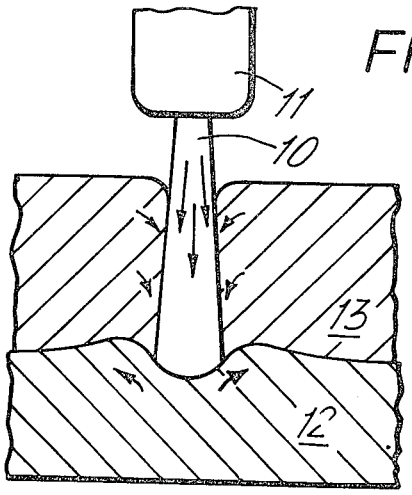
FIG.4a.
FIG.4b.
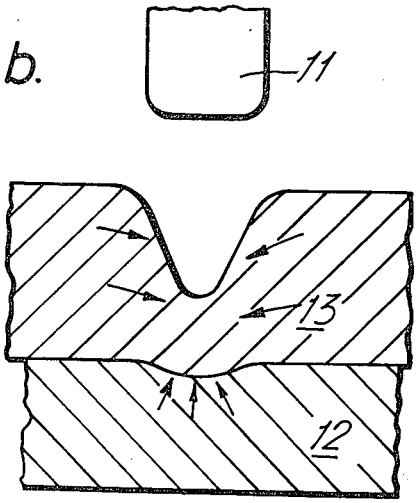
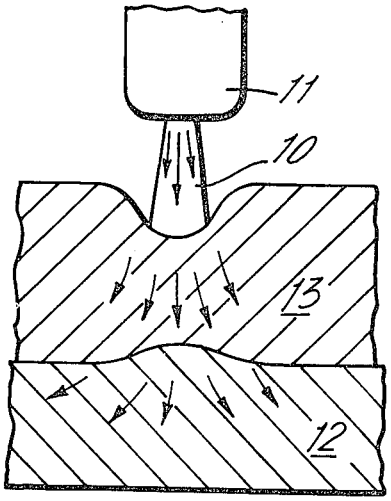
FIG.4c.

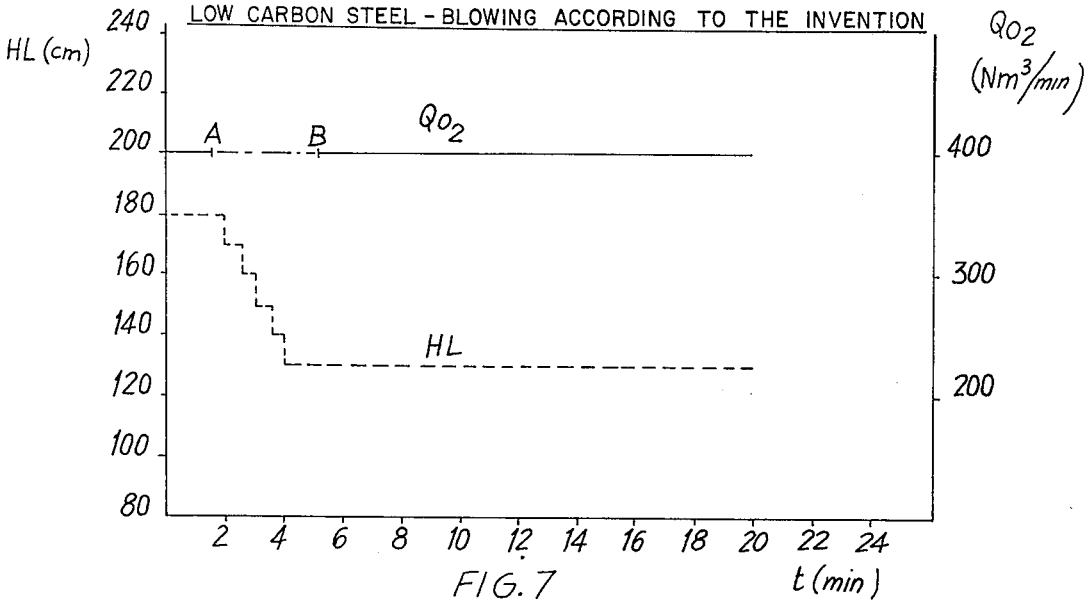
FIG. 7
FIG. 8
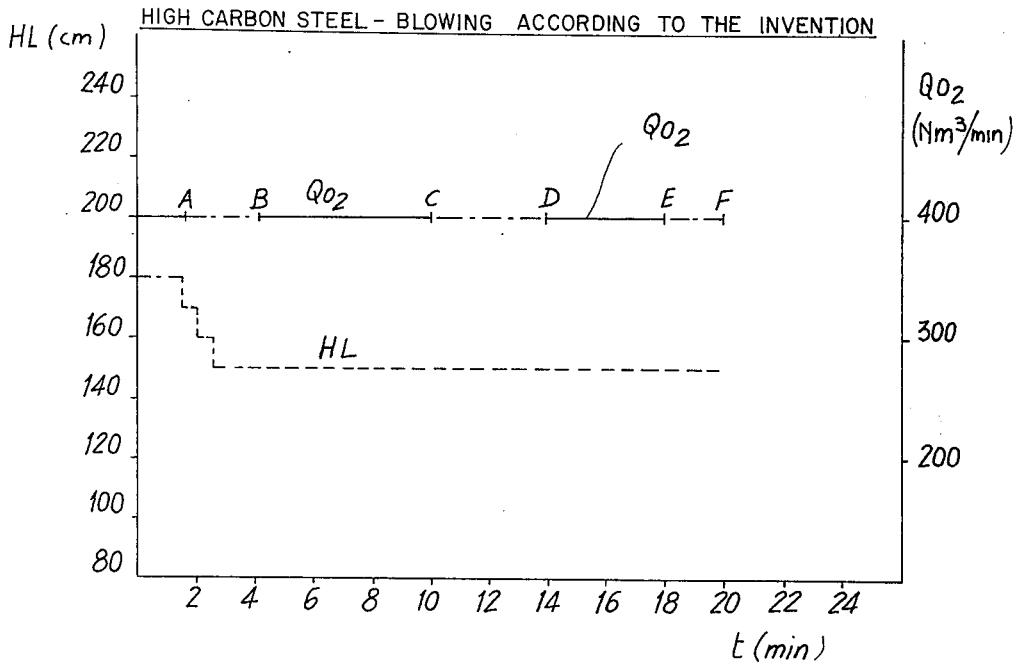

OXYGEN OUTPUT IN EACH NOZZLE

METHOD AND DEVICE FOR BLOWING OXYGEN IN METAL REFINING CONVERTERS IN UNSTATIONARY MANNER

This application is a continuation-in-part of application Ser. No. 590,227, filed June 25, 1975, which, in turn, is a continuation of application Ser. No. 391,382, filed Aug. 24, 1973 and now abandoned.

BACKGROUND OF THE INVENTION

The present invention relates to a method and relevant apparatus for blowing oxygen into, for instance, L.D. converters (Linz Donawitz converters) in unstationary manners or by varying the delivery of oxygen into the converter.

The reaction rates theoretically obtainable between carbon and oxygen in the present physical conditions of L. D. converters, are substantially higher than those obtained in practice.

Certain reaction of the refining process takes place less quickly than possible because of the relatively little amount of interaction between the various layers of material in the converter. This is particularly true of the reactions of desulphoration, dephosphoration, oxidation of manganese, and formation of the slag because of relatively little interaction between the slag and the underlying material.

The deficiency in the reactions between slag and underlying materials results in the difficulty of producing in L.D. converters, steels with higher qualitative characteristics and the reduction of these deficiencies will obtain from the same converters higher quality steels with high specific deliveries, that is, with higher yield.

As the coefficients of mass transportation are sufficiently high even for the metal-slag reactions, the limitation to the interaction between the steps present, and consequently to the reaction rates, consists in the reduced exchange surfaces between said steps. The limited exchange surfaces are caused by that through the present blowing manners the drawing of the slag in the bath, and in general the beginning of the contact between the steps, are entrusted only and exclusively to the partial turbulence of the oxygen jets and to the consequent phenomena of instability present in the oxygen-bath interface.

The partial turbulence of the oxygen jets opening into the passage conduits through the slag layer, is useful as on the lateral surfaces of said conduits is exerted an action of drawing for the slag by said jets. Besides, this fact justifies the increase in the number of the nozzles in the blowings with high deliveries, for the consequent increase in the lateral surfaces of the conduits.

Further, the turbulence of the oxygen jets originates phenomena of unstability on the surface of the impression on the bath, said instability being sufficient for the oxygen mixing in the other steps.

The phenomena described originate the dispersion of the various components of the burden which, being the system essentially constituted by a fluid matrix, tend to separate under the action of the gravity field; said separation is balanced by the arrival of new amounts of components in form of liquid or gaseous particles, owing to the action of the oxygen jets.

As said mixing is associated to instability phenomena, though present also at the oxygen-slag interface, it occurs for fair amounts of the system components, that is in a discontinuous way. It results that, in order to improve the mixing and consequently the interaction of the various steps, it is advisable to favor a discontinuous series of phenomena.

In order to increase the instability phenomena present in the slag and bath, or to originate them when they are not yet present, it is possible to act on the feeding of the oxygen phase, making it discontinuous or particularly giving it a pulsating feature.

OBJECT OF THE INVENTION

In view of the foregoing, the present invention aims to provide a blowing of oxygen into converters in unstationary manners, performed by means of temporaneous partializations of the nozzles of the lance heads, or by means of instantaneous decreases in the penetration capacity of the oxygen jets throughout the blowing process or during a part only of same.

SUMMARY OF THE INVENTION

The temporaneous partialization of said nozzles according to the invention may be performed in the following ways:

1. by introducing from the lateral surface of a nozzle a pin (lateral pin) which, suitably shaped, reduces to a given section the zone available for the passage of oxygen;

2. by partializing the converging portion and/or the groove section of the nozzle by means of a pin moving along the nozzle axis (axial pin);

3. by means of a rotating partialization element suitably shaped and arranged in the inlet section of said nozzles.

Both the lateral pin and the axial pin as well as the rotating partialization means may be moved by any mechanism which may also allow the adjustment of the stroke of said pins or of the rotating speed of said partialization means, as well as the changes in the partialization times and in the operating times with a non-partialized nozzle. The partialization of a nozzle may also be such as not to allow any passage of oxygen (complete closing of the nozzle).

The decrease in the penetrating capacity of the oxygen jets may be obtained in the following ways:

a. by varying the geometry of the nozzle in the time, so as to change its expansion ratio and/or generate superficial irregularities in the diverging portion;

b. by secondary jets of fluids injected through the side walls of said nozzles and/or jets of liquid or solid particles injected into the oxygen stream upstream of said nozzle or into same;

c. by means of acoustic fields, generated to the purpose, which interfere with the single jets and decrease their penetration onto the bath;

d. by varying the feeding pressure upstream of said nozzles.

BRIEF DESCRIPTION OF THE DRAWINGS

In order that the invention may be clearly understood, it will now be described, by way of example, with particular reference to the accompanying drawings, wherein:

FIGS. 4*a*, 4*b* and 4*c* show the effect of the blowing of oxygen in unstationary manner through a vertical section passing through the axis of a nozzle and through the thickness of the slag floating on the metal bath;

FIGS. 7 and 8 are similar to FIGS. 5 and 6, respectively, but refer to a refining process applying unstationary blowing of oxygen according to the invention;

FIG. 14 also includes the graphs marked (CO), ($CO_2$) and ($CO + CO_2$), representing the instantaneous delivery of the oxygen used for the production of CO, $CO_2$, respectively as well as the sum of said gaseous compounds. In FIG. 14, the dashed area shows the amount of oxygen brought about by the slag.

DESCRIPTION OF THE PREFERRED EMBODIMENTS

Figure 1:
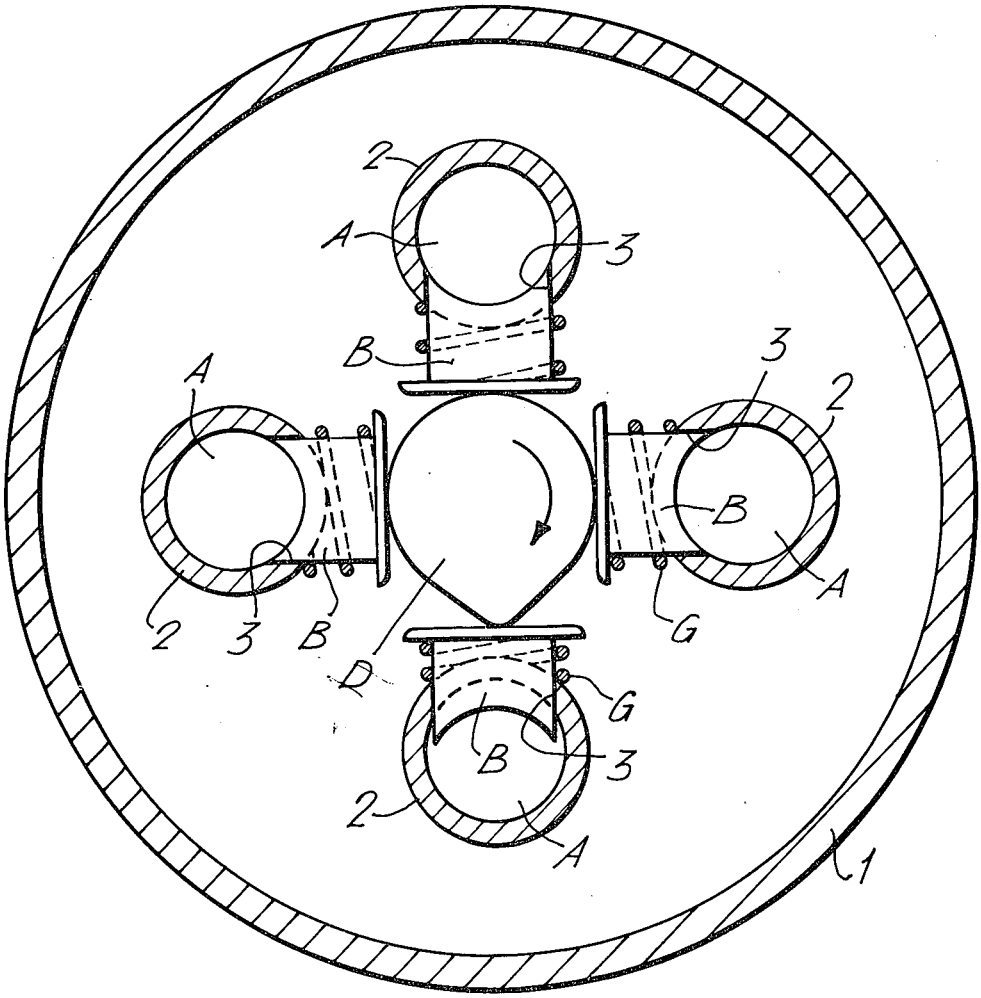
FIG. 1 shows a section of the head of an oxygen blowing lance, according to a plane perpendicular to said lance axis; said lance having four nozzles, and in this particular embodiment of the invention, the conduits of each of said nozzles have side intercepting pin controlled by a central rotating cam.

FIG. 1 shows by way of example the partialization mechanism in the head of a lance with four nozzles arranged circumferentially by means of the lateral pin system. Said figure shows the section of head 1 of the oxygen blowing lance along a plane normal to the axis of said lance, with the four nozzles A for the passage of oxygen. In the nozzle side wall 2, through suitable cavities 3, are arranged the side pins B which, in their inoperative position, are kept in retracted position by springs G. A cam D, rotating about an axis coinciding with the lance axis, during its rotation presses alternatively on side pins B which, by going forward, partialize the oxygen passage section.

The profiles of said cam and said side pin ends in mutual contact, are such as to perform said partialization in the most suitable manner. Particularly, said cam may have several projections, i.e., it is not necessary that it partializes a single nozzle for each of its turn. The rotating speed of said cam may vary even during the same blowing process. The cam profile may be such that, in given positions of said cam, no one of the nozzles is partialized. The cam rotation may be clockwise or counterclockwise, and said direction may be reversed one or more times during the same blowing process.

Said side pin B may be actuated also through a solenoid electromagnetic system, not shown in the drawings. In this case, it is possible to vary very easily the times of partialization and, independently therefrom, the times of nonpartialized operation. Further, it is easily possible to reverse the sequence of partialization. Finally, the control of said side pin B may be performed through a pneumatic system, not shown in the drawings.

Figure 2:
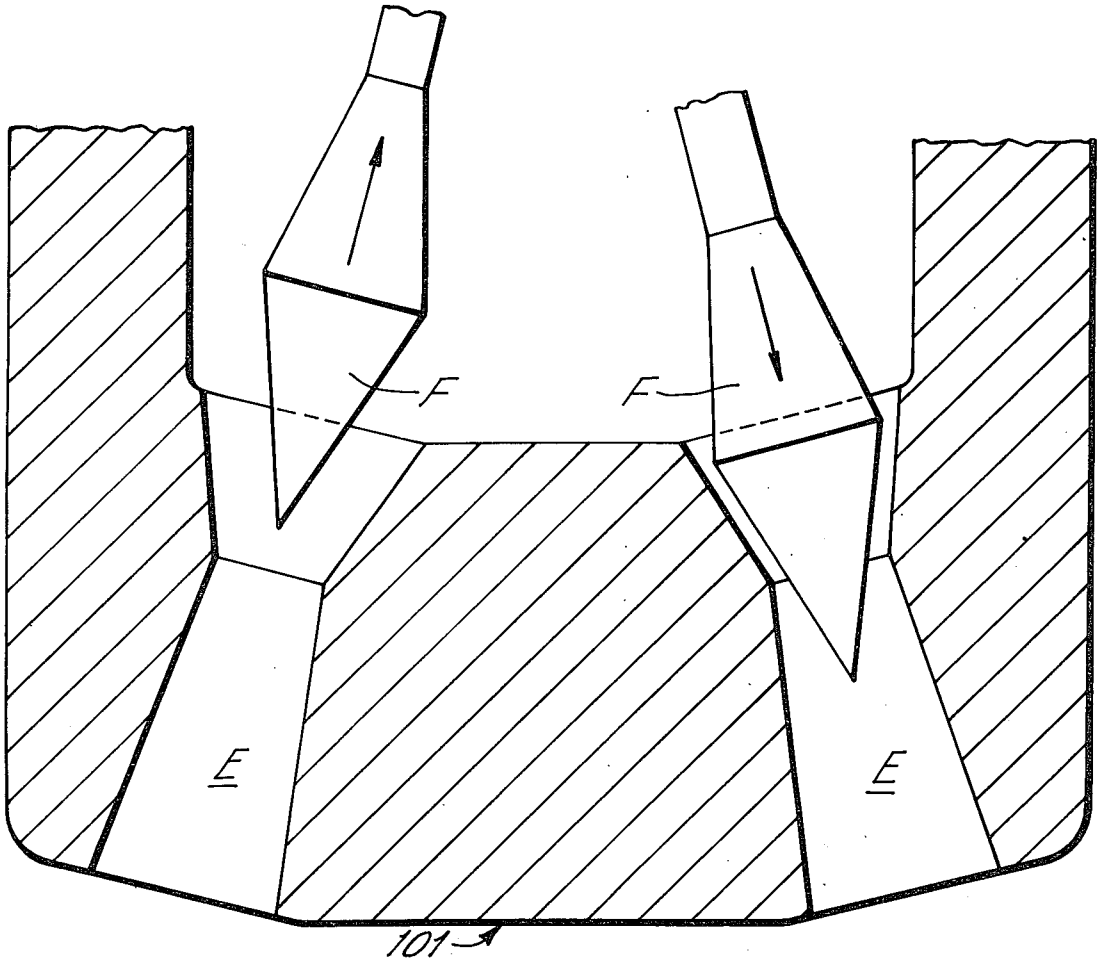
FIG. 2 shows an axial section of the head of an oxygen blowing lance along to a plane passing through the axis of two of the nozzles arranged on the lance ends; in this case, the pin intended for intercepting the passage section of the oxygen are arranged axially with respect to the associated nozzles.

FIG. 2 shows an example of the other suggested method of partialization embodied by means of axial pins F. The figure represents the section of one end of the oxygen blowing lance 101 according to a plane comprising the axis of said lance with the nozzles for the passage of oxygen E. Said axial pins F, provided with an alternative motion to the direction of the nozzle axis, may obstruct fully or partly the oxygen passage sections.

The sequence and frequency of the partializations, as well as the "time of partialization/time of non-partialized blowing" ratio, may be any one and may vary during the blowing process. Said pins are not to be necessarily in an axial-symmetric form, and may keep lifted (thus not partializing the nozzles) for given periods of time during the blowing. The stroke of the axial pins may be variable. The control mechanisms for the axial pins may be similar to the ones mentioned for the side pins, or different. The axis of the pin can form with the nozzle axis a small angle.

Figure 3:
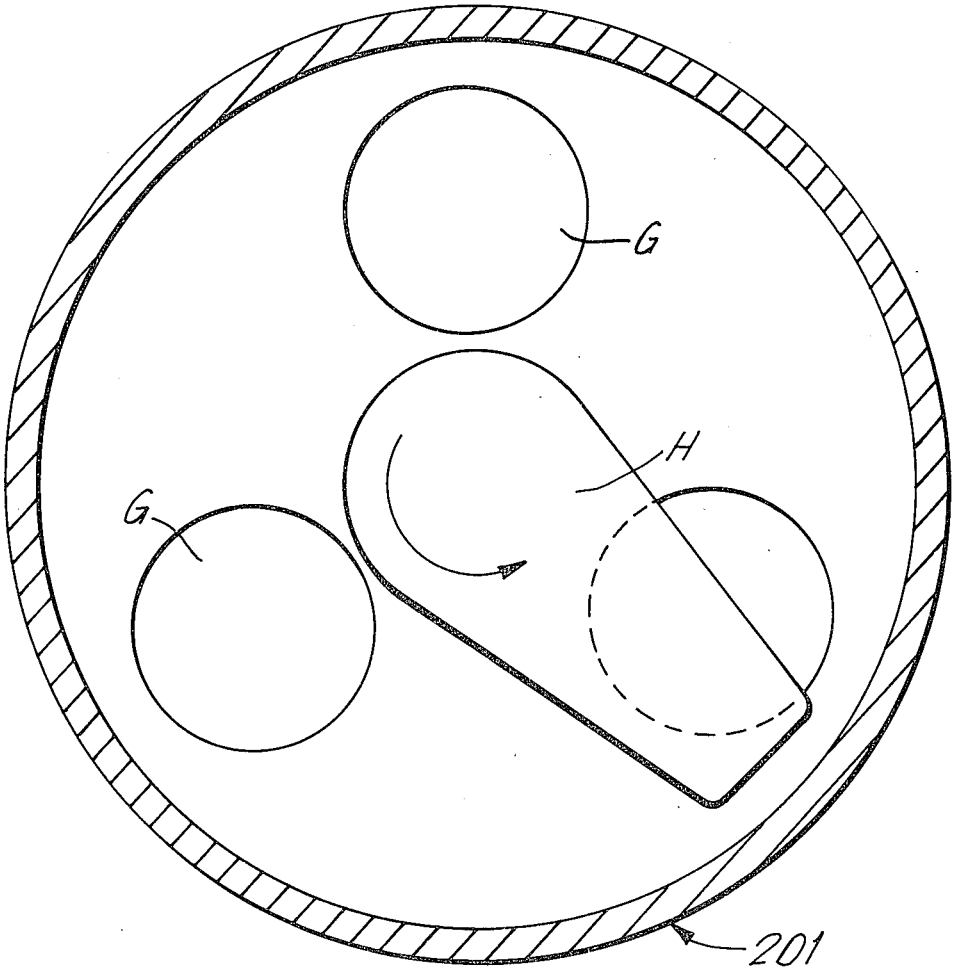
FIG. 3 is a section similar to the one of FIG. 1; however, in this case, the shutting of the port of the nozzles arranged on the end of the lance head, is obtained through a single rotating device capable of covering and uncovering successively all said nozzles.
Figure 5:
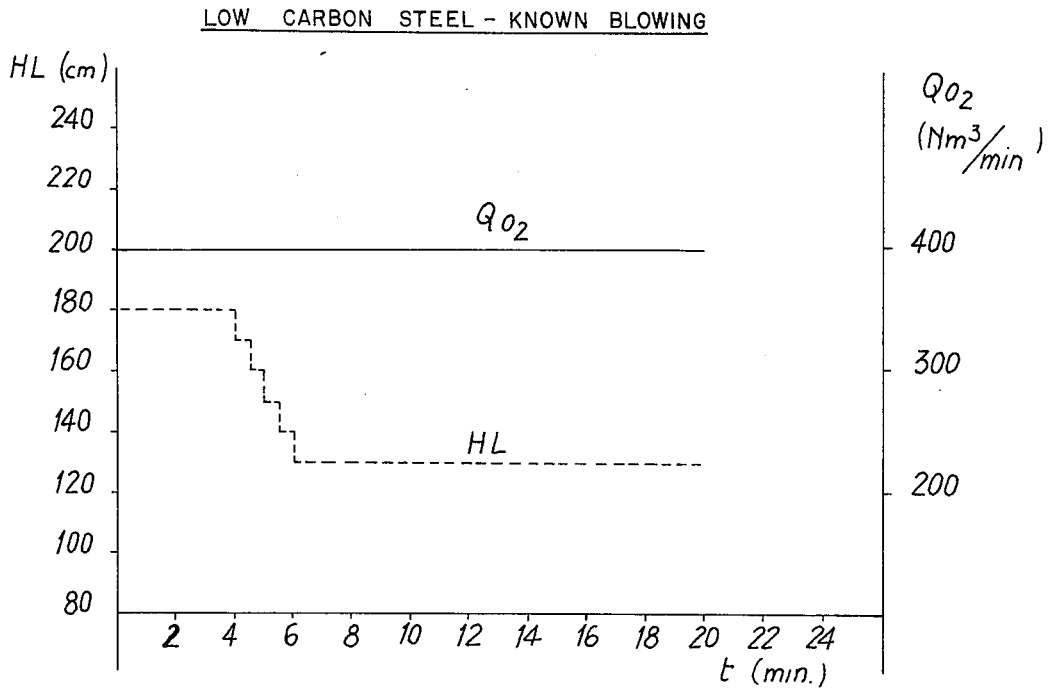
FIG. 5 shows the variation in oxygen delivery ($Q_{02}$) during a known refining process, as well as the height (HL) of the lance head in respect with the molten metal's surface; said figure refers to the refining of a low carbon steel.

FIG. 3 shows an example of partialization mechanism for a lance head 201 with three nozzles G, provided with a rotating partialization means H. Said figure shows the section of the lance head according to a plane normal to the axis of said lance, close to the inlet sections of oxygen to said nozzles G. Said partialization means H, which rotates about an axis coinciding with the lance axis, during its rotation obstructs alternatively the inlet sections of the nozzles, partializing so the oxygen delivery. The rotation speed of said partialization means is not to be necessarily constant but may vary during a same process of blowing, permitting so a variation in the partialization times and, independently from the latter, the times of the non-partialized operation. The profile of said partialization means may be such that, in given positions thereof, none of said nozzles is partialized. The rotation direction of said partialization means may be clockwise or counterclockwise and may be reversed one or more times during a single blowing process. One of the effects of the oxygen blowing into L.D. converters with unstationary manner is pointed out in FIG. 4. Jet 10 outflowing of one of the nozzles of the head of lance 11, in the conditions of non-partialized nozzle (FIG. 4a), keeps its main function of making oxygen interact with bath 12 and with the side surface of the passage conduit that it opens through slag 13; when the nozzle is partialized, as the penetrating capacity of the jet originating therefrom is null or very little, slag 13 tends to fill the conduit previously formed moving from the periphery towards same (FIG. 4b); when the partialization is removed, the new jet with high penetration outflowing of the nozzle directly hits the slag, which had fully or partly filled said conduits, and draws it into the bath.

Further, as the jets hit in an unstationary way (see particularly for instance FIG. 1 with a rotating sequence), they, besides originating the bath circulation and the slag circulation on planes laying on the converter axis, create motions normal to said axis, i.e., parallel to the bath surface. Finally, when during said blowing the direction of rotation in the jets partialization is reversed, the starting phenomena in the bath and slag originates waving phenomena which originate motions interesting a substantial volume of the burden.

The advantages resulting from a feeding of unstationary type are the following: the slag is drawn in a discontinuous way (therefore renewed) and with a higher rate (therefore in a higher amount) into the metal bath. The phenomena of interface instability are increased and it results therefrom a higher dispersion of the slag into small size particles, and thus a better bath-slag emulsion with a shorter average life.

In other words, there is a substantial increase in the mass transport fenomena owing to a larger interface surface between slag and bath, and to higher differences in concentration between the components interested in the reactions, which results in a better kynetic of the latter.

Further, owing to the reciprocation in the same zone of the presence or not of the oxygen jets, there is a drawing of the slag and bath towards the center of the converter, and finally tangential motions are inducted which generate a higher circulation in both the bath and the slag. The stirring caused by the various kinds of inducted motions has the effect of homogenizing both the slag and bath, not only with respect to the various components present therein, but also with respect to the distribution of temperatures.

Said oxygen blowing with unstationary manners may be embodied in installations already operating without high charges for modifying same, as it is only necessary to modify the lance heads and part of the lance conduits.

With special reference to FIGS. 5 to 14:

The following are two examples of implementation of the process according to the invention, to obtain low carbon steel (example No. 1) and high carbon steel (example No. 2), respectively. Said examples show the differences in refining processes by blowing or in a known manner and by unstationary blowing according to the invention.

EXAMPLE NO. 1

In a 150 ton converter, transform cast iron having the following composition into low carbon steel ($\alpha = 0.06$):

| | | | | |
|---|---|---|---|---|
| C | 4.00 | - | 4.50 | % |
| Si | 4.5 | - | 4.7 | % |
| Mn | 4.0 | - | 8.0 | % |
| P | 0.08 | - | 0.20 | % |
| S | 0.015 | - | 0.080 | % |

The converter has a three-nozzle head for oxygen blowing. The oxygen delivery values show a constant trend (FIG. 6) when a conventional process is applied. It must however be noted that, in a known manner, the oxygen delivery may have two or more constant value sections.

In conventional blowing, the oxygen delivery from each nozzle is generally equal to the total delivery divided by the number of lance nozzles.

Figure 9:
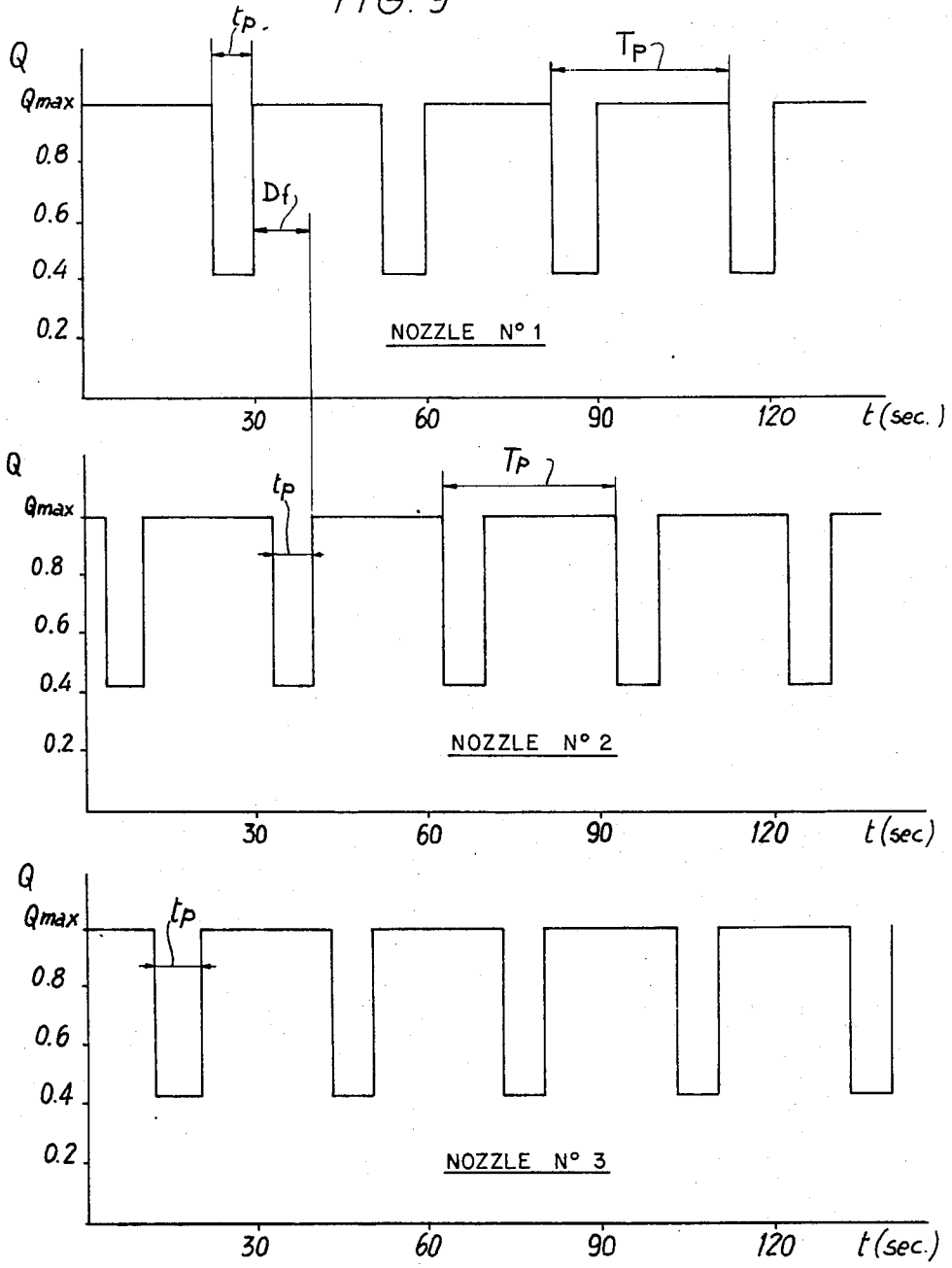
FIG. 9 shows the delivery of oxygen in the three nozzles of a same oxygen blowing lance, during the time intervals when unstationary blowing according to the invention takes place; said time intervals when unstationary blowing takes place are shown by broken line A–B in FIG. 7 and broken lines A–B, C–D, E–F in FIG. 8.

In unstationary blowing according to the invention, (FIG. 7) the delivery of each lance nozzle is variable as shown in FIG. 9 for a time period A–B.

The length of section A–B of FIG. 7 depends on the kind of cast iron, and, more particularly, on the sulphur and phosphorous percentage contents. In FIG. 7, the length of section A–B is equal to approximately 3 minutes. During such time lapse, the delivery of each lance nozzle is reduced down to 40% of its maximum value every 30 seconds ($T_p$) and kept at said minimum value for 7 seconds ($t_p$).

As clearly shown in FIG. 9, the choking of the three lance nozzles is out of phase in time by approximately 10 seconds (df).

Another parameter illustrating the difference between conventional blowing processes and the blowing process according to the invention is the formation of slag. This parameter can be measured by a device called acoustic probe, producing a graph of the type shown in FIG. 10. In said figure, the sound intensity is proportional to the thickness of the slag layer deposited on top of the liquid metal bath; more particularly, the height of the slag layer is proportional to the distance ($Hs_i$) of each point of the diagram from the horizontal line (m) passing the peak point (M) of said diagram.

Figure 10:
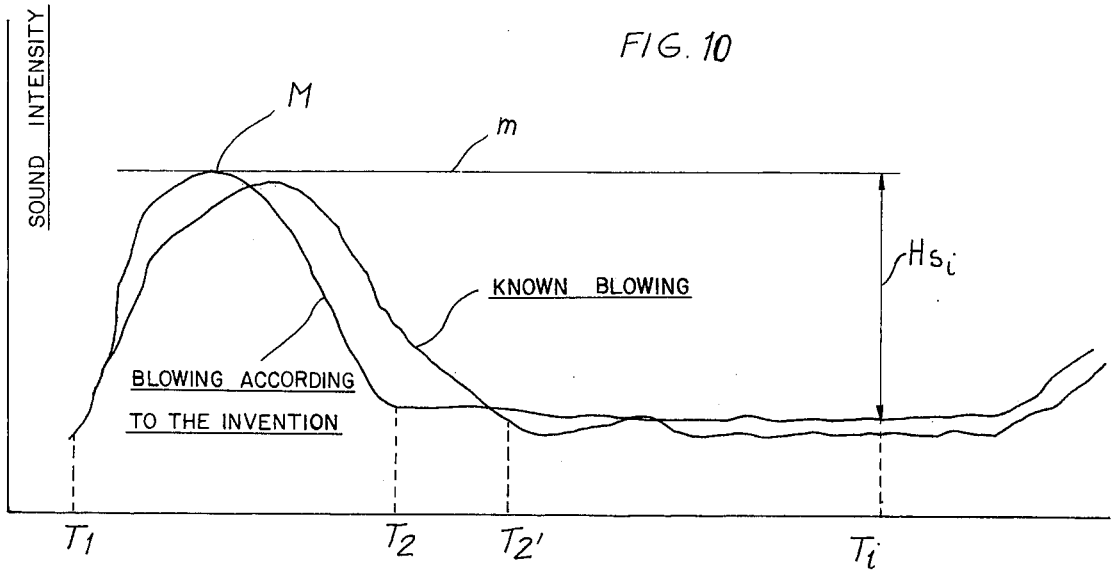
FIG. 10 shows the intensity of sound caused by oxygen blowing at refining time, with unstationary blowing according to the invention and with conventional oxygen blowing, respectively.

Section T1–T2 of FIG. 10 represents the slag-formation time; it is also called silicon combustion time. It is evident from FIG. 10 that the time interval T1–T2 when the process is applied according to the invention is shorter than the corresponding time interval T1–T2' when oxygen is blown in a conventional manner.

It must be noted that the length of time interval T1–T2 is also depending on desulphuration and dephosphuration times; hence, nozzle choking according to the invention constitutes a further possibility of influencing the cast iron refining process in addition to the other usual parameters, such as lance height variation and total oxygen delivery.

It clearly appears that the process according to the invention, as illustrated by the quantitative features of the present example, offers the expert in the art a new parameter, capable of affecting the refining process: it also appears that the use of said parameter brings into being a variation in the value of other parameters normally applied, such as, indeed, lance height and oxygen delivery.

The invention allows for reduced flux consumption; for an increase in the cast iron's analytical limits and in the maximum oxygen delivery obtainable in a given capacity converter.

Hence a reduction in refining time and/or improved characteristics in the final steel product.

Figure 11:
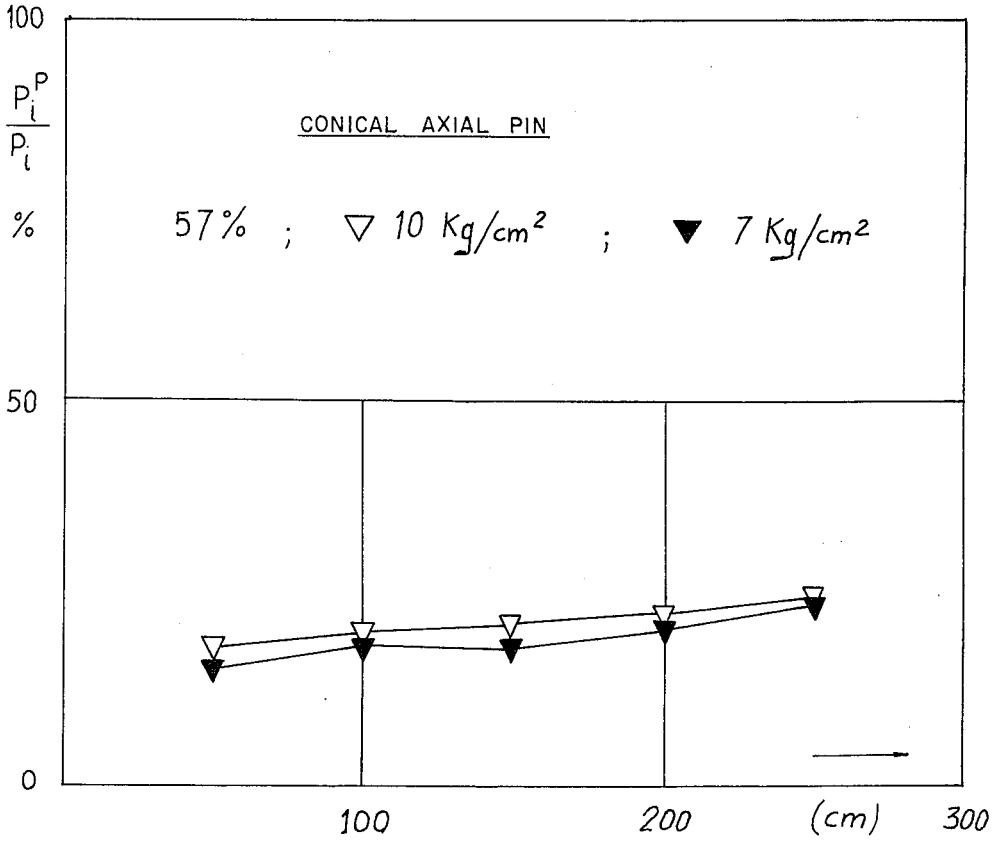
FIG. 11 shows the graph of ratio ($p^p_i/p_i$) depending on the variation of the lance height with respect to the liquid bath surface, when applying the process according to the invention, and when the oxygen feeding pressure is equal to 10 Kg./cm$^2$ (white triangles) and 7 Kg./cm$^2$ (black triangles), respectively. In said figure, ($p^P_i$) shows the oxygen pressure at the bath surface level when the nozzle is choked to the utmost, (57% of the unchoked throt section area), whilst ($p_i$) show the pressure at the bath surface level when the nozzle is not choked.
Figure 12:
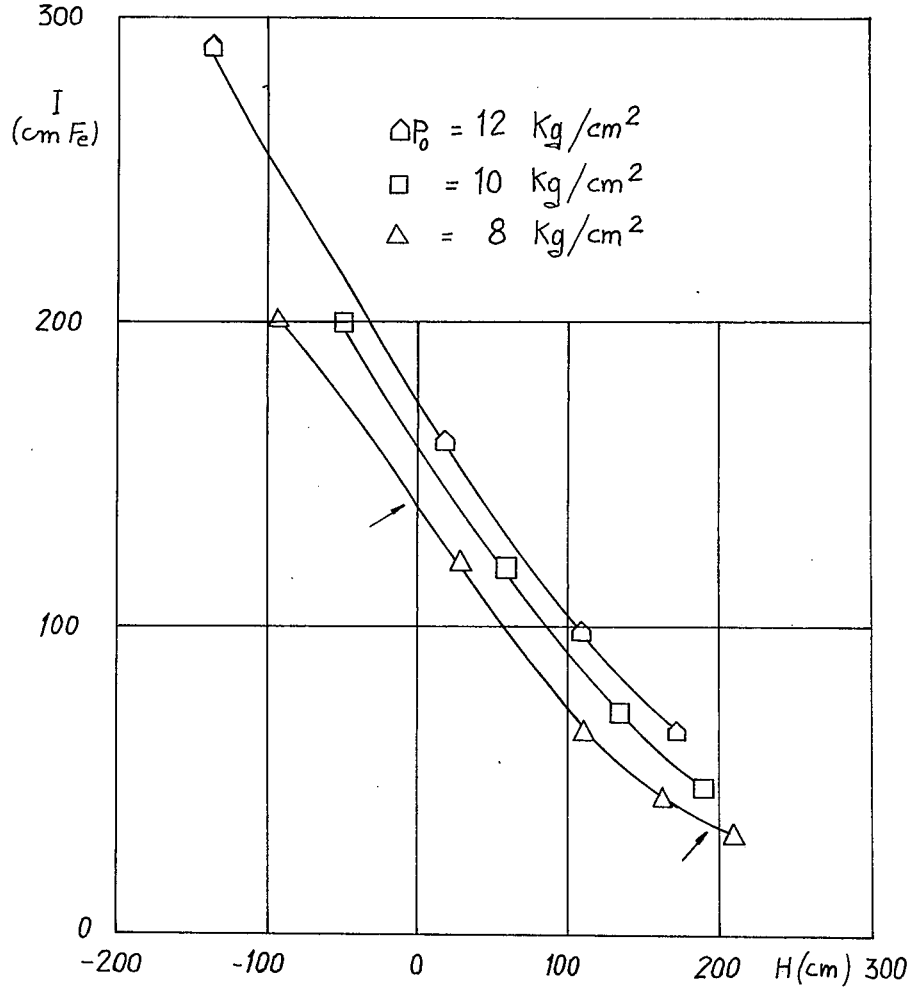
FIG. 12 is similar to FIG. 11, but it refers to a known oxygen blowing process; in this figure, the gas jet impulse on the bath surface, (in cm/Fe), is indicated on the axis of ordinates.
Figure 13:
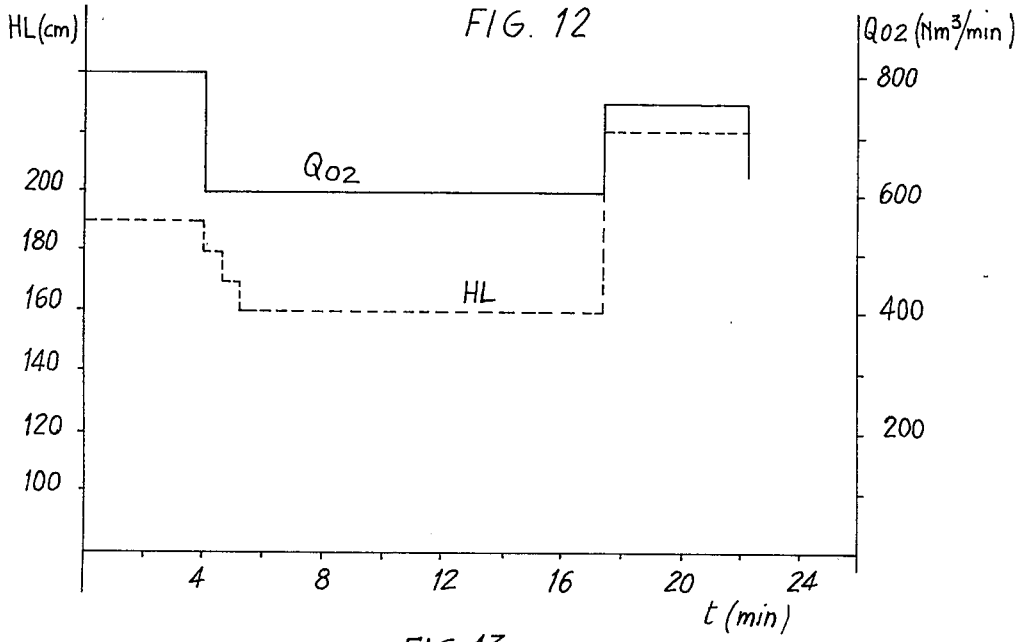
FIG. 13 is similar to FIG. 5, but it refers to cast iron refining in a 300 ton converter to obtain a low carbon steel; in this case, oxygen blowing takes place in three stages, with different delivery values.
Figure 14:
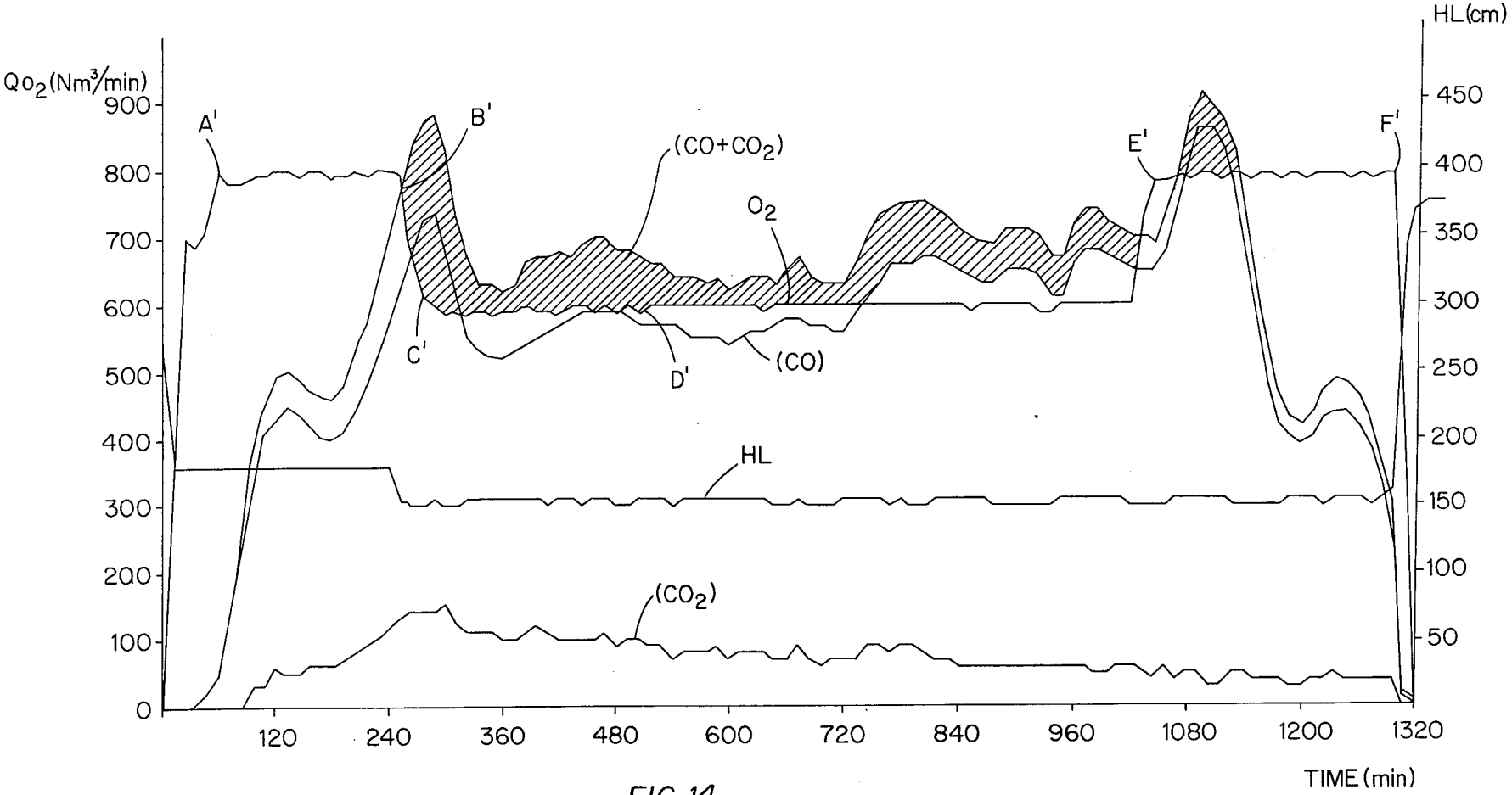
FIG. 14 is similar to the above, but it refers to unstationary oxygen blowing, according to the invention, in sections A1-B1, C1-D1, E1-F1.

FIG. 11 shows the percentage reduction of oxygen jet pressure on the metal bath when the section of each nozzle is reduced in cycle down to 57% of its unchocked value. It is interesting to note that said pressure is reduced to approximately 25% of its maximum value, and that said reduced value is practically unaffected by the lance head distance from the metal bath surface.

All other conditions being equal, but in the absence of unstationary blowing as provided by the invention, the amplitude of the lance head from the bath level up to 200 cm. above it would not be sufficient to obtain a corresponding reduction of the gaseous jet pressure against the bath surface.

EXAMPLE NO. 2

The cast iron's composition and converter's capacity are the same as those shown in Example 1. In this instance, however, a high carbon steel is desired (0.40 – 0.80%).

Figure 6:
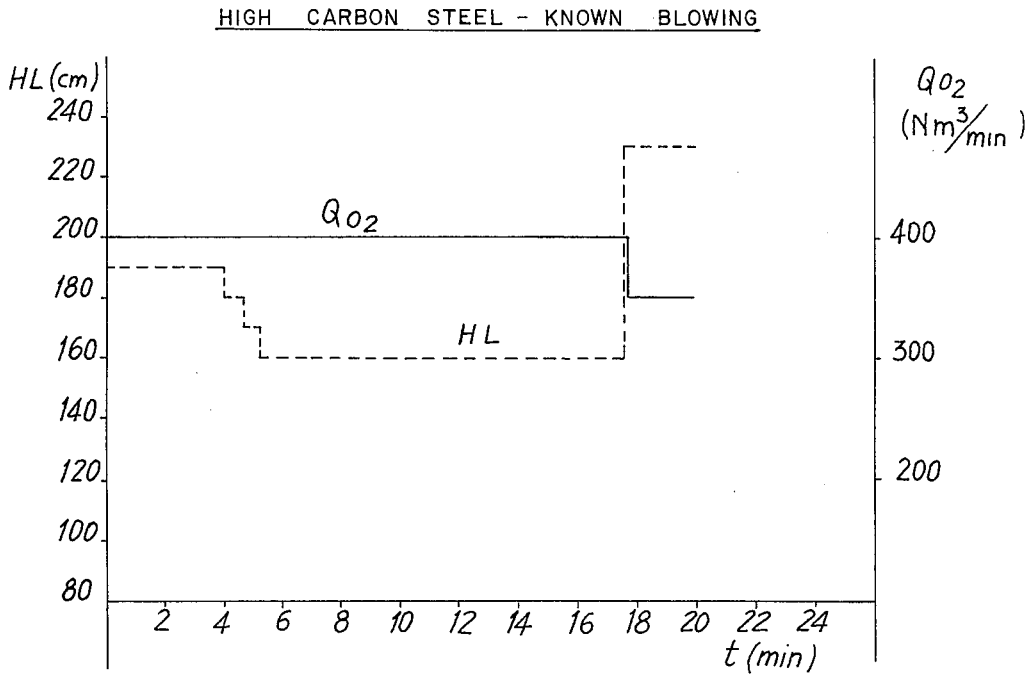
FIG. 6 is similar to the above, but it refers to the refining of a high carbon steel.

This second example is illustrated in FIG. 6 (conventional blowing) and FIG. 8 (unstationary blowing according to the invention). Sections A–B, C–D, and E–F of the curve representing the oxygen delivery in FIG. 8 are reproduced on a larger scale in FIG. 9.

EXAMPLE NO. 3

Cast iron having the same composition as in Example 1 is poured into a 300 ton converter. Afterwards, oxygen is blown in for approximately 22 minutes.

Said oxygen blowing takes place in three stages:

1st stage: Approximately 4 minutes, during which slag is formed. The oxygen delivery is equal to approximately 800 $Nm^3$/sec., i.e., about 4 $Nm^3$/sec. per ton of cast iron. The oxygen feeding pressure is equal to 10 kg./$cm^2$. According to the invention, during the A-B interval of said first stage, the individual nozzles of a four-nozzle lance are successively choked every 36 seconds. The maximum choking time is approximately 10 seconds. A similar choking takes place during the C-D interval of the Second stage of the refining process, during which most of the carbon to be eliminated is combined with oxygen so as to obtain CO and CO2. During the third or final stage of the refining process, which takes approximately 4 minutes, the choking of the lance head nozzles is extended to interval E–F.

It is to be understood that the invention is not limited to the examples shown. It is intended to cover all modifications and equivalents within the scope of the appended claims.

What is claimed is:

1. In a steel refining process in which jets or oxygen are blown onto the surface of the material in a converter, the step of positively inducing variations of the delivery of oxygen from the jets during at least a part of an oxygen blowing period to vary penetration of the jets into materials in the converter.

2. The process of claim 1, wherein said variations of the delivery are effected by cyclically varying the flow cross section of nozzles from which said jets issue.

3. The process of claim 2 wherein said nozzles are completely obturated during a part of a cyclical variation of the flow cross section of said nozzle.

4. The process of claim 1 wherein the variations in delivery are effected by cyclically varying the geometry of nozzles from which those jets issue.

5. The process of claim 4 wherein variations in the geometry of the nozzles is effected by moving an obturating element within the nozzles.

6. The process as claimed in claim 5 wherein said obturating element is moved transversely of flow through the nozzle.

7. The process as claimed in claim 5 wherein said obturating element is moved longitudinally of flow through the nozzle.

8. The process as claimed in claim 4 wherein said variations are effected by moving an obturating element cyclically across a nozzle outlet.

9. The process of claim 1 wherein the period of such a variation of the delivery of oxygen is between 10 and 150 seconds and in such a period the minimum flow rate of oxygen is maintained between 2 and 10 seconds.

10. The process as claimed in claim 1 wherein the period of such a variation of the delivery of oxygen is between 10 and 150 seconds and in such a period the minimum flow rate of oxygen is maintained between 2 and 10 seconds and wherein the variations in delivery are effected by cyclically varying the geometry of nozzles from which those jets issue and wherein said obturating element is moved transversely of flow through the nozzle so as to reduce the flow cross section of nozzles down to between 40% of its unchocked value.

11. The process as claimed in claim 10 wherein said obturating element is moved longitudinally of flow through the nozzle, so as to reduce the flow cross section of the nozzle down to 10% of its unchocked value.

12. The process as claimed in claim 1 wherein the period of such variation of the delivery of oxygen is between 10 and 150 seconds and in such a period the minimum flow rate of oxygen is maintained between 2 and 10 seconds and wherein the variations in delivery are effected by varying the geometry of nozzles from which those jets issue and wherein said variations are effected by moving an obturating element cyclically across the nozzle outlet.

* * * * *